US008268452B2

(12) United States Patent
Lyons et al.

(10) Patent No.: US 8,268,452 B2
(45) Date of Patent: Sep. 18, 2012

(54) BONDING AGENTS FOR IMPROVED SINTERING OF EARTH-BORING TOOLS, METHODS OF FORMING EARTH-BORING TOOLS AND RESULTING STRUCTURES

(75) Inventors: Nicholas J. Lyons, Houston, TX (US); Jimmy W. Eason, The Woodlands, TX (US); Redd H. Smith, The Woodlands, TX (US); John H. Stevens, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 279 days.

(21) Appl. No.: 11/831,814

(22) Filed: Jul. 31, 2007

(65) Prior Publication Data

US 2009/0031863 A1 Feb. 5, 2009

(51) Int. Cl.

| | |
|---|---|
| ***B32B 15/04*** | (2006.01) |
| ***B32B 15/16*** | (2006.01) |
| ***B32B 9/00*** | (2006.01) |
| ***B22F 7/00*** | (2006.01) |
| ***B22F 7/06*** | (2006.01) |
| ***E21B 10/00*** | (2006.01) |
| ***E21B 10/08*** | (2006.01) |
| ***E21B 10/36*** | (2006.01) |

(52) U.S. Cl. ..... 428/577; 428/615; 428/680; 428/673; 175/327; 175/332; 175/336; 175/374; 175/425; 175/435; 175/331; 419/5; 419/6; 419/10; 419/38; 419/46

(58) Field of Classification Search ..... 428/577, 428/607, 614, 615, 627, 680, 673, 668, 678, 428/542.8

See application file for complete search history.

(56) References Cited

U.S. PATENT DOCUMENTS 3,471,921 A 10/1969 Feenstra (Continued)

FOREIGN PATENT DOCUMENTS

DE 3347501 A1 9/1985

OTHER PUBLICATIONS

U.S. Appl. No. 11/635,432, filed Dec. 7, 2006 and entitled "Displacement Members and Methods of Using Such Displacement Members to Form Bit Bodies of Earth-Boring Rotary Drill Bits," Smith et al.

(Continued)

*Primary Examiner* — Michael La Villa
(74) *Attorney, Agent, or Firm* — TraskBritt

(57) ABSTRACT

Methods for forming earth-boring tools include providing a metal or metal alloy bonding agent at an interface between a first element and a second element and sintering the first element, the second element, and the boding agent to form a bond between the first element and the second element at the interface. The methods may be used, for example, to bond together portions of a body of an earth-boring tool (which may facilitate, for example, the formation of cutting element pockets) or to bond cutting elements to a body of an earth-boring tool (e.g., a bit body of a fixed-cutter earth-boring drill bit or a cone of a roller cone earth-boring drill bit). At least partially formed earth-boring tools include a metal or metal alloy bonding agent at an interface between two or more elements, at least one of which may comprise a green or brown structure.

27 Claims, 4 Drawing Sheets

U.S. PATENT DOCUMENTS

| | | | | |
|---|---|---|---|---|
| 5,780,139 | A | 7/1998 | Carter et al. | |
| 5,829,539 | A | 11/1998 | Newton et al. | |
| 6,063,333 | A * | 5/2000 | Dennis | 419/6 |
| 6,505,673 | B1 | 1/2003 | Abuaf et al. | |
| 6,599,465 | B1 | 7/2003 | Reppel et al. | |
| 6,669,745 | B2 | 12/2003 | Prichard et al. | |
| 6,908,688 | B1 | 6/2005 | Majagi et al. | |
| 7,128,980 | B2 | 10/2006 | Schedler et al. | |
| 7,154,736 | B2 | 12/2006 | Kirsten | |
| 7,377,341 | B2 | 5/2008 | Middlemiss et al. | |
| 2004/0108041 | A1 | 6/2004 | Kirsten | |
| 2004/0126612 | A1 | 7/2004 | Shinkai et al. | |
| 2004/0245024 | A1 * | 12/2004 | Kembaiyan | 175/425 |
| 2007/0056776 | A1 * | 3/2007 | Overstreet | 175/426 |
| 2007/0102198 | A1 | 5/2007 | Oxford et al. | |
| 2007/0102199 | A1 | 5/2007 | Smith et al. | |

OTHER PUBLICATIONS

U.S. Appl. No. 11/710,091, filed Feb. 23, 2007 and entitled "Earth-Boring Tools and Cutter Assemblies Having a Cutting Element Co-Sintered With a Cone Structure, Methods of Using the Same," Lyons et al.

U.S. Appl. No. 11/717,905, filed Mar. 13, 2007 and entitled "Earth-Boring Tools Having Pockets for Receiving Cutting Elements Therein and Methods of Forming Such Pockets and Earth-Boring Tools," Duggan et al.

PCT International Search Report mailed Nov. 6, 2008, for Application No. PCT/US2008/071733.

* cited by examiner

BONDING AGENTS FOR IMPROVED SINTERING OF EARTH-BORING TOOLS, METHODS OF FORMING EARTH-BORING TOOLS AND RESULTING STRUCTURES

FIELD OF THE INVENTION

The present invention relates generally to earth-boring tools and methods of forming earth-boring tools. More particularly, the present invention relates to methods of securing together elements or portions of an earth-boring tool that comprise a particle-matrix composite material.

BACKGROUND OF THE INVENTION

Rotary drill bits are commonly used for drilling bore holes or wells in earth formations. Rotary drill bits include two primary configurations. One configuration is the roller cone bit, which typically includes three roller cones mounted on support legs that extend from a bit body. Each roller cone is configured to spin or rotate on a support leg. Cutting teeth typically are provided on the outer surfaces of each roller cone for cutting rock and other earth formations. The cutting teeth often are composed of steel and coated with an abrasion resistant "hardfacing" material. Such materials often include tungsten carbide particles dispersed throughout a metal alloy matrix material. Alternatively, receptacles are provided on the outer surfaces of each roller cone into which hardmetal inserts are secured to form the cutting elements. The roller cone drill bit may be placed in a bore hole such that the roller cones are adjacent the earth formation to be drilled. As the drill bit is rotated, the roller cones roll across the surface of the formation, the cutting teeth crushing the underlying formation.

A second configuration of a rotary drill bit is the fixed-cutter bit (often referred to as a "drag" bit), which typically includes a plurality of cutting elements secured to a face region of a bit body. Generally, the cutting elements of a fixed-cutter type drill bit have either a disk shape or a substantially cylindrical shape. A hard, super-abrasive material, such as mutually bonded particles of polycrystalline diamond, may be provided on a substantially circular end surface of a supporting substrate of each cutting element to provide a cutting surface. Such cutting elements are often referred to as "polycrystalline diamond compact" (PDC) cutting elements. Typically, the cutting elements are fabricated separately from the bit body and secured within pockets formed in the outer surface of the bit body. A bonding material such as an adhesive or, more typically, a braze alloy may be used to secure the cutting elements by their substrates to the bit body. The fixed-cutter drill bit may be placed in a bore hole such that the cutting elements are adjacent the earth formation to be drilled. As the drill bit is rotated, the cutting elements scrape across and shear away the surface of the underlying formation.

The bit body of a rotary drill bit conventionally is secured to a hardened steel shank having an American Petroleum Institute (API) threaded pin for attaching the drill bit to a drill string. The drill string includes tubular pipe and equipment segments coupled end to end between the drill bit and other drilling equipment at the surface. Equipment such as a rotary table or top drive may be used for rotating the drill string and the drill bit within the bore hole. Alternatively, the shank of the drill bit may be coupled directly to the drive shaft of a down-hole motor, which then may be used to rotate the drill bit.

A conventional earth-boring rotary drill bit 10 that has a bit body including a particle-matrix composite material is illustrated in FIG. 1. As seen therein, the drill bit 10 includes a bit body 12 that is secured to a steel shank 20. The bit body 12 includes a crown 14, and a steel blank 16 that is embedded in the crown 14. The crown 14 includes a particle-matrix composite material 15 such as, for example, particles of tungsten carbide embedded in a copper alloy matrix material. The bit body 12 is secured to the steel shank 20 by way of a threaded connection 22 and a weld 24 that extends around the drill bit 10 on an exterior surface thereof along an interface between the bit body 12 and the steel shank 20. The steel shank 20 includes an API threaded pin 28 for attaching the drill bit 10 to a drill string (not shown).

The bit body 12 includes wings or blades 30, which are separated by junk slots 32. Internal fluid passageways (not shown in FIG. 1) extend between the face 18 of the bit body 12 and a longitudinal bore 40, which extends through the steel shank 20 and partially through the bit body 12. Nozzle inserts (not shown) may be provided at face 18 of the bit body 12 within the internal fluid passageways.

A plurality of PDC cutting elements 34 are provided on the face 18 of the bit body 12. The PDC cutting elements 34 may be provided along the blades 30 within pockets 36 formed in the face 18 of the bit body 12, and may be supported from behind by buttresses 38, which may be integrally formed with the crown 14 of the bit body 12.

The steel blank 16 shown in FIG. 1 is generally cylindrically tubular. Alternatively, the steel blank 16 may have a fairly complex configuration and may include external protrusions corresponding to blades 30 or other features extending on the face 18 of the bit body 12.

During drilling operations, the drill bit 10 is positioned at the bottom of a well bore hole and rotated while drilling fluid is pumped to the face 18 of the bit body 12 through the longitudinal bore 40 and the internal fluid passageways. As the PDC cutting elements 34 shear or scrape away the underlying earth formation, the formation cuttings and detritus are mixed with and suspended within the drilling fluid, which passes through the junk slots 32 and the annular space between the well bore hole and the drill string to the surface of the earth formation.

Conventionally, bit bodies that include a particle-matrix composite material, such as the previously described bit body 12, have been fabricated by infiltrating hard particles with molten matrix material in graphite molds. In some instances, ceramic molds, cast from rubber masters, have been employed. The cavities of the graphite molds are conventionally machined with a five-axis machine tool. Fine features are then added to the cavity of the graphite mold by hand-held tools. These features are typically present in the rubber master used to cast ceramic molds. Additional clay work also may be required to obtain the desired configuration of some features of the bit body. Where necessary, preform elements or displacements (which may comprise ceramic components, graphite components, or resin-coated sand or other compacted particulate ceramic compact components) may be positioned within the mold and used to define the internal passages, cutting element pockets 36, junk slots 32, and other external topographic features of the bit body 12. The cavity of the mold is filled with hard particulate carbide material (such as tungsten carbide, titanium carbide, tantalum carbide, etc.). The preformed steel blank 16 may then be positioned in the mold at the appropriate location and orientation. The steel blank 16 typically is at least partially submerged in the particulate carbide material within the mold.

The mold then may be vibrated or the particles otherwise packed to decrease the amount of space between adjacent particles of the particulate carbide material. A matrix material, such as a copper-based alloy, may be melted, and the particulate carbide material may be infiltrated with the molten matrix material. The mold and bit body 12 are allowed to cool to solidify the matrix material. The steel blank 16 is bonded to the particle-matrix composite material, which forms the crown 14, upon cooling of the bit body 12 and solidification of the matrix material. Once the bit body 12 has cooled, the bit body 12 is removed from the mold and any displacements are removed from the bit body 12. Destruction of the mold typically is required to remove the bit body 12.

As previously described, destruction of the mold typically is required to remove the bit body 12. After the bit body 12 has been removed from the mold, the bit body 12 may be secured to the steel shank 20. As the particle-matrix composite material used to form the crown 14 is relatively hard and not easily machined, the steel blank 16 is used to secure the bit body 12 to the steel shank 20. Threads may be machined on an exposed surface of the steel blank 16 to provide the threaded connection 22 between the bit body 12 and the steel shank 20. The steel shank 20 may be screwed onto the bit body 12, and the weld 24 then may be provided along the interface between the bit body 12 and the steel shank 20.

The PDC cutting elements 34 may be bonded to the face 18 of the bit body 12 after the bit body 12 has been cast by, for example, brazing, mechanical affixation, or adhesive affixation. Alternatively, the PDC cutting elements 34 may be provided within the mold and bonded to the face 18 of the bit body 12 during infiltration or furnacing of the bit body 12 if thermally stable synthetic diamonds, or natural diamonds, are employed.

However, there is a continuing need in the art for methods of forming cutting element pockets on earth-boring rotary drill bits that avoid the tool path interference problems discussed above and that do not require use of additional support elements.

BRIEF SUMMARY OF THE INVENTION

In some embodiments, the present invention includes methods of forming earth-boring tools in which a bonding agent which may comprise a metal or metal alloy material, is provided at an interface between a first element and a second element. The first element, the second element, and the bonding agent may be sintered to form a bond between the first element and the second element. One or both of the first element and the second element may comprise a particle-matrix composite material. The first element and the second element may comprise any element or portion of an earth-boring tool.

In additional embodiments, the present invention includes earth-boring tools that are at least partially formed and include a bonding agent at an interface between a first element and a second element, in which at least one of the first element and the second element comprise a green or brown structure.

BRIEF DESCRIPTION OF THE SEVERAL VIEWS OF THE DRAWINGS

While the specification concludes with claims particularly pointing out and distinctly claiming that which is regarded as the present invention, various features and advantages of this invention may be more readily ascertained from the following description of the invention when read in conjunction with the accompanying drawings, in which.

DETAILED DESCRIPTION OF THE INVENTION

Figure 1:
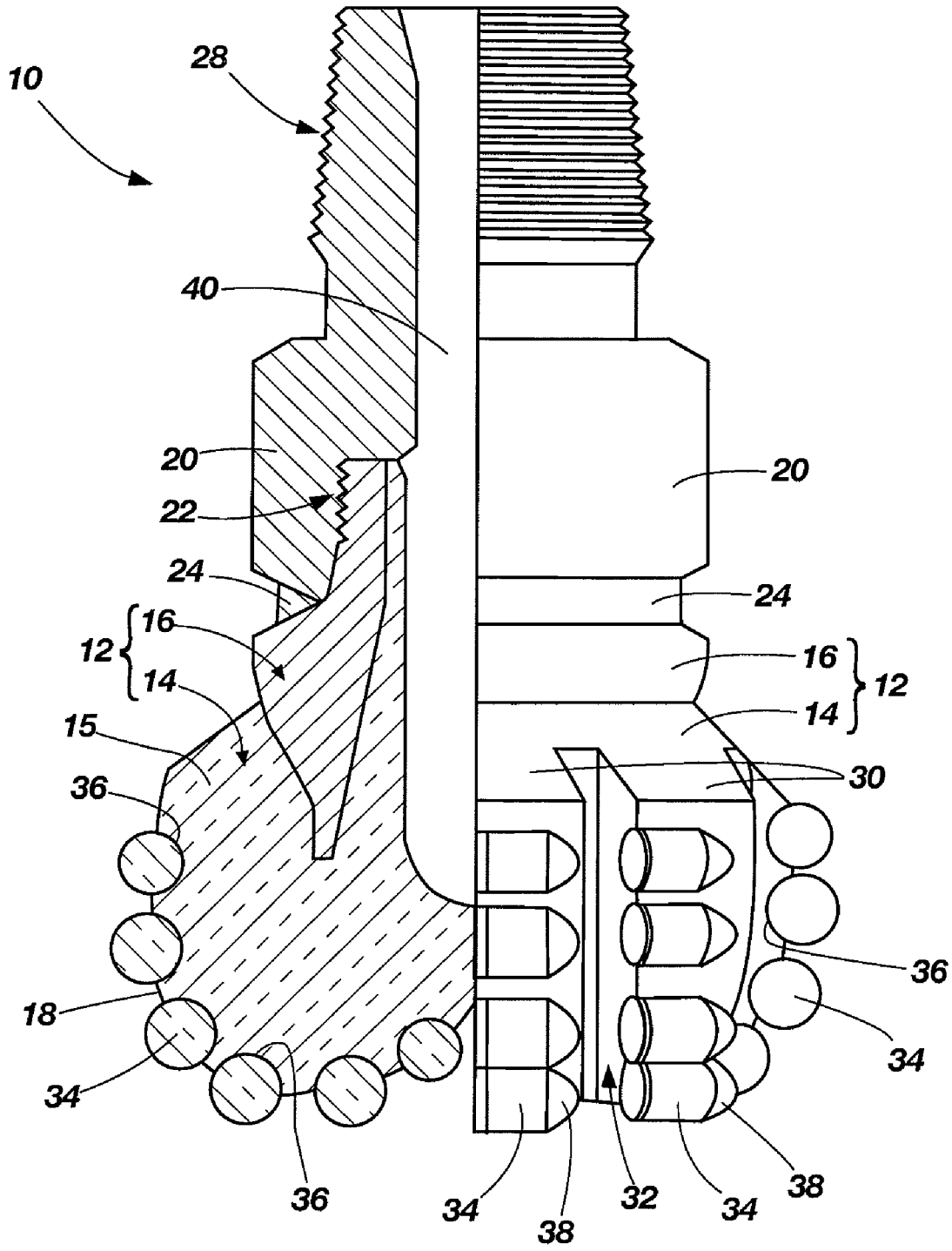
FIG. 1 (PRIOR ART)
FIG. 1 is a perspective view of an earth-boring rotary drill bit.

The illustrations presented herein are, in some instances, not actual views of any particular cutting element insert, cutting element, or drill bit, but are merely idealized representations which are employed to describe the present invention. Additionally, elements common between figures may retain the same numerical designation.

The term "green" as used herein means unsintered.

The term "green bit body" as used herein means an unsintered structure comprising a plurality of discrete particles held together by a binder material, the structure having a size and shape allowing the formation of a bit body suitable for use in an earth-boring drill bit from the structure by subsequent manufacturing processes including, but not limited to, machining and densification.

The term "brown" as used herein means partially sintered.

The term "brown bit body" as used herein means a partially sintered structure comprising a plurality of particles, at least some of which have partially grown together to provide at least partial bonding between adjacent particles, the structure having a size and shape allowing the formation of a bit body suitable for use in an earth-boring drill bit from the structure by subsequent manufacturing processes including, but not limited to, machining and further densification. Brown bit bodies may be formed by, for example, partially sintering a green bit body.

The term "sintering" as used herein means densification of a particulate component involving removal of at least a portion of the pores between the starting particles (accompanied by shrinkage) combined with coalescence and bonding between adjacent particles.

As used herein, the term "[metal] material" (where [metal] is any metal) means commercially pure [metal] in addition to metal alloys or mixtures wherein the weight percentage of [metal] in the alloy or mixture is greater than the weight percentage of any other component of the alloy or mixture.

As used herein, the term "material composition" means the chemical composition and microstructure of a material. In other words, materials having the same chemical composition but a different microstructure are considered to have different material compositions.

As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

Recently, new methods of forming rotary drill bits having bit bodies comprising particle-matrix composite materials have been developed in an effort to improve the performance and durability of earth-boring rotary drill bits. Such methods are disclosed in U.S. patent application Ser. No. 11/271,153 (which is entitled "Earth-Boring Rotary Drill Bits And Methods Of Manufacturing Earth-Boring Rotary Drill Bits Having Particle-Matrix Composite Bit Bodies," was filed Nov. 10, 2005, now U.S. Pat. No. 7,802,409, issued Sep. 28, 2010, and is assigned to the same assignee of the present invention) and U.S. patent application Ser. No. 11/272,439 (which is entitled "Earth-Boring Rotary Drill Bits And Methods Of Forming Earth-Boring Rotary Drill Bits," was filed Nov. 10, 2005, now U.S. Pat. No. 7,776,256, issued Aug 17, 2010, and is assigned to the same assignee of the present invention), the disclosure of each of which application is incorporated herein in its entirety by this reference.

In contrast to conventional infiltration methods (in which hard particles (e.g., tungsten carbide) are infiltrated by a molten liquid metal matrix material (e.g., a copper-based alloy) within a refractory mold), these new methods generally involve pressing a powder mixture to form a green powder compact, and sintering the green powder compact to form a bit body. The green powder compact may be machined or modified as necessary or desired prior to sintering using conventional machining and shaping techniques like those used to form steel bit bodies. Furthermore, additional machining or shaping processes may be performed after sintering the green powder compact to a partially sintered brown state, or after sintering the green powder compact to a desired final density.

During the fabrication of a bit body of a rotary drill bit using such methods, it may be necessary or desirable to bond at least one green or brown element to another green, brown, or fully sintered element during a sintering process. By way of example and not limitation, two or more elements, each comprising a portion of a bit body, may be bonded together during a sintering process to form a unitary bit body, as described with reference to FIGS. 2A and 2B below.

Figure 2A:
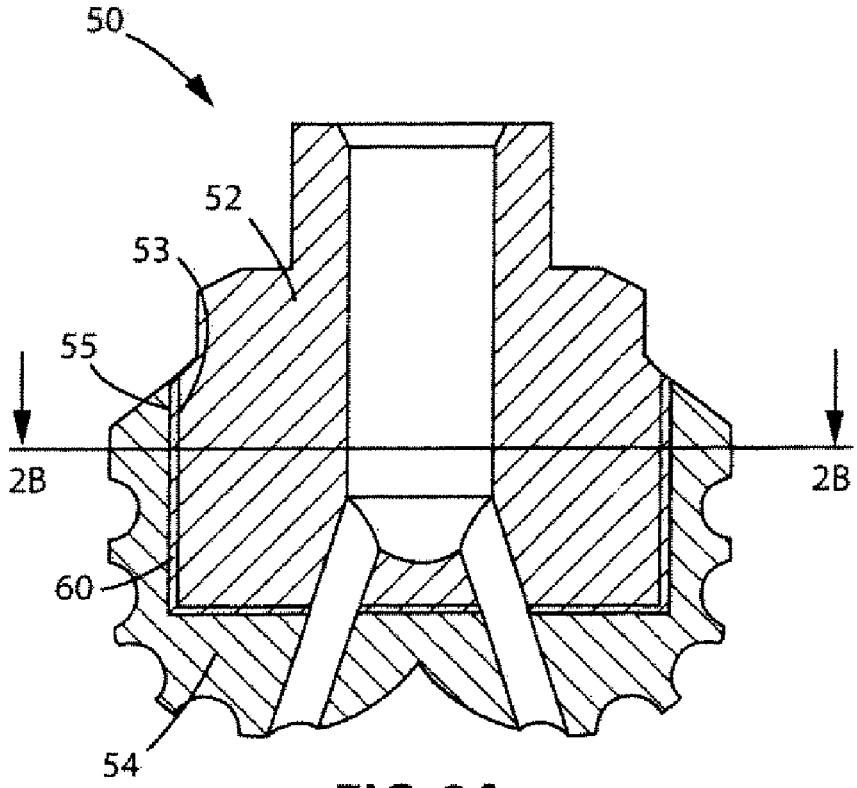
FIG. 2A is a cross-sectional side view of a partially formed bit body of an earth-boring rotary drill bit that may be formed according to an embodiment of the present invention.
Figure 2B:
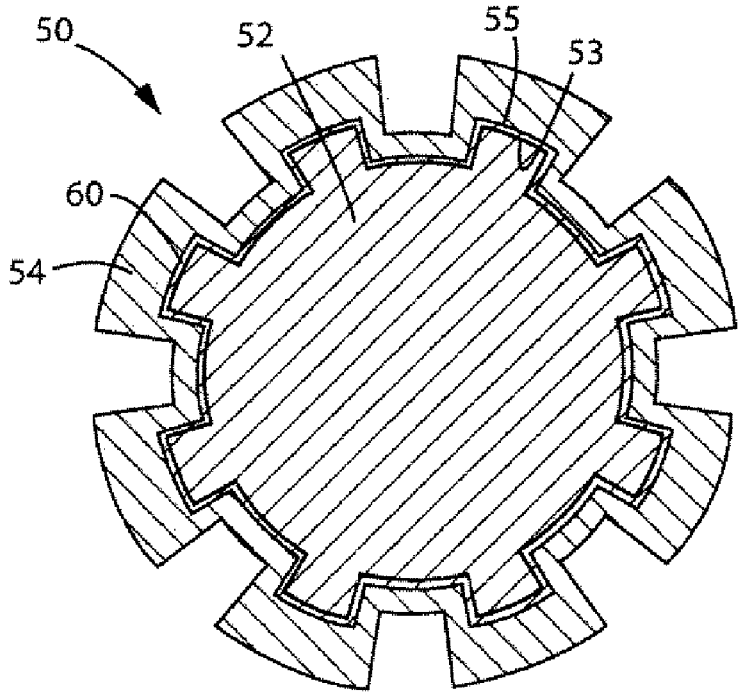
FIG. 2B is a cross-sectional view of the bit body shown in FIG. 2A taken along section line 2B-2B shown therein.

FIG. 2A is a cross-sectional side view of a partially formed bit body 50. The bit body 50 includes a first element 52 forming a first region of the bit body 50 and a second element 54 forming a second region of the bit body 50. FIG. 2B is a cross-sectional view of the partially formed bit body 50 shown in FIG. 2A taken along section line 2B-2B shown therein.

At least one of the first element 52 and the second element 54 may be less than fully sintered. The first element 52 and the second element 54 may be assembled together, as shown in FIGS. 2A and 2B, and the resulting assembly may be sintered in a subsequent process to secure the first element 52 and the second element 54 together to form a fully sintered bit body 50. In some embodiments, the first element 52 and the second element 54 each may comprise a green structure or a brown structure. In additional embodiments, one of the first element 52 and the second element 54 may comprise a green structure, and the other of the first element 52 and the second element 54 may comprise a brown structure. In yet further embodiments, one of the first element 52 and the second element 54 may comprise a fully sintered structure, and the other of the first element 52 and the second element 54 may comprise a green structure or a brown structure.

During such a sintering process, any structure that is less than fully dense (e.g., a green structure or a brown structure) may undergo shrinkage. Such shrinkage may cause a surface of the less than fully dense structure to pull or shark away from an opposing surface of an adjacent structure in such a manner as to prevent the opposing surfaces from bonding together during the sintering process. Explaining further, as a non-limiting example, each of the first element 52 and the second element 54 may comprise green structures. During a sintering process used to bond the first element 52 and the second element 54 together, the first element 52 may undergo shrinkage, which may cause the surfaces 53 that are vertically oriented in FIG. 2A to retract or pull away from the opposing surfaces 55 of the second element 54. Similarly, the second element 54 may undergo shrinkage, which may cause the surfaces 55 that are vertically oriented in FIG. 2A to retract or pull away from the opposing surfaces 53 of the first element 52. As a result upon sintering, there may be one or more regions at the interface between the first element 52 and the second element 54 at which the first element 52 and the second element 54 are not bonded together. In other words, there may be one or more voids at the interface between the first element 52 and the second element 54 after sintering.

In embodiments of the present invention, a metal material may be provided at the interface between the first element 52 and the second element 54 prior to sintering the first element 52 and the second element 54 to enhance the formation of a bond therebetween during sintering. Such a metal or metal alloy is referred to herein as a "bonding agent." By way of example and not limitation, a foil 60 may be provided over or along at least a portion of the interface between the first element 52 and the second element 54, as shown in FIGS. 2A and 2B. The foil 60 may comprise a metal or metal alloy bonding agent having a melting point below a temperature at which the first element 52 and the second element 54 are to be sintered. The bonding agent may be wettable to at least one material of the first element 52 and the second element 54, such that, upon melting of the foil 60 during sintering, surface tension causes the molten bonding agent of the foil 60 to form a fluid bridge between the exposed, opposing surfaces 53, 55 of the first element 52 and the second element 54 at the interface therebetween, which may facilitate the formation of an enhanced bond or joint between the first element 52 and the second element 54.

The metal or metal alloy of the bonding agent may be chemically compatible with the materials of the first element 52 and the second element 54, such that materials (e.g., intermetallic compounds) exhibiting undesirable physical properties (e.g., brittleness) are not formed at the interface between the first element 52 and the second element 54 during the sintering process. In some embodiments, the metal or metal alloy bonding agent may be substantially identical to a material of one or both of the first element 52 and the second element 54. For example, each of the first element 52 and the second element 54 may comprise a particle matrix composite material, each comprising a plurality of hard particles and a matrix material, as discussed in further detail below. In such embodiments, the metal or metal alloy bonding agent may be substantially identical to the matrix material of one or both of the first element 52 and the second element 54.

By way of example and not limitation, the foil 60 may have a thickness of between about five microns (5 μm) and about five hundred and fifty microns (550 μm). The foil 60 may be applied to one or both of the first element 52 and the second element 54 prior to assembling together the first element 52 and the second element 54. Furthermore, the foil 60 may be applied to at least a portion of one or more surfaces of the first element 52, to at least a portion of one or more surfaces of the second element 54, or to at least a portion of one or more surfaces of both the first element 52 and the second element 54.

In some embodiments, the foil 60 may be formed as a substantially planar sheet, and the foil 60 may be caused to conform to the surfaces of the first element 52 and/or the second element 54 merely by pressing the foil 60 against the surfaces and causing the foil 60 to deform so as to conform to the surfaces of the first element 52 and/or the second element 54. In additional embodiments, the foil 60 may be preformed (e.g., stamped, cast, etc.) to have a conformal shape to that of the surfaces of the first element 52 and/or the second element 54 to which the foil 60 is to be applied.

In additional embodiments of the present invention, the metal or metal alloy bonding agent provided at the interface between the first element 52 and the second element 54 may not comprise a foil (like the foil 60), and may comprise a powder, a paste, a film, a coating, or any other form of material. As non-limiting examples, a powder comprising relatively fine particles of the metal or metal alloy bonding agent may be applied to the complementary surfaces of the first element 52 and/or the second element 54. Additionally, a coating of the bonding agent may be applied to the complementary surfaces of the first element 52 and/or the second element 54 by one or more of a flame spraying process, an electroplating process, an electroless plating process, or a vapor deposition process (e.g., physical vapor deposition (PVD) or chemical vapor deposition (CVD)). In yet additional methods, the first element 52 and the second element 54 may be assembled together, and the metal or metal alloy bonding agent may be brazed into the interface between the first element 52 and the second element 54. In other words, the first element 52 and the second element 54 may be assembled together, and the bonding agent may be melted and applied along an exposed edge of the interface between the first element 52 and the second element 54 in the molten state. Surface tension between the molten bonding agent and each of the first element 52 and the second element 54 may cause the molten bonding agent to be drawn into and along the interface therebetween. Optionally, the first element 52 and the second element 54 may be heated to an elevated temperature to prevent the molten bonding agent from prematurely solidifying, which may prevent the interface between the first element 52 and the second element 54 from being sufficiently filled with the molten bonding agent.

As previously mentioned, the first element 52 and the second element 54 each may comprise a green, brown, or fully sintered structure formed by mixing hard particles with particles comprising a matrix material (together with any necessary or desirable organic binders, lubricants, adhesives, etc.) to form a powder mixture, and pressing the powder mixture to form a powder compact. If either the first element 52 or the second element 54 comprises a brown or fully sintered structure, the powder compact may be sintered to the desired state. Methods of forming such powder compacts, as well as methods for sintering such powder compacts, are more fully described in, for example, the aforementioned U.S. patent application Ser. No. 11/271,153, filed Nov. 10, 2005, and U.S. patent application Ser. No. 11/272,439, also filed Nov. 10, 2005.

By way of example and not limitation, the hard particles used to form the first element 52 and the second element 54 may comprise a hard material such as diamond, boron carbide, boron nitride, aluminum nitride, and carbides or borides of the group consisting of W, Ti, Mo, Nb, V, Hf, Zr, Si, Ta, and Cr, and the particles comprising the matrix material may comprise a cobalt-based alloy, an iron-based alloy, a nickel-based alloy, a cobalt and nickel-based alloy, an iron and nickel-based alloy, an iron and cobalt-based alloy, an aluminum-based alloy, a copper-based alloy, a magnesium-based alloy, or a titanium-based alloy.

As one particular non-limiting example, the hard particles may comprise tungsten carbide, and the matrix material may comprise a metal alloy predominantly comprised of one or both of nickel and cobalt. In other words, the matrix material may comprise greater than about fifty atomic percent (50 at %) of one or both of nickel and cobalt. Furthermore, the matrix material may exhibit a melting point of between about one thousand and fifty degrees Celsius (1050° C.) and about one thousand, three hundred, and fifty degrees Celsius (1350° C.). In such an embodiment, the metal or metal alloy bonding agent applied to the interface between the first element 52 and the second element 54 may have a melting point that is between about sixty percent (60%) and one hundred percent (100%) of the melting point of the matrix material, may be wettable to both tungsten carbide and the matrix material. As one particular non-limiting example, the metal or metal alloy bonding agent also may be predominantly comprised of nickel, a nickel-based alloy, cobalt, a cobalt-based alloy, silver, or a silver-based alloy. The bonding agent may further comprise at least one constituent, the identity and concentration of which is selected to reduce the melting point of the bonding agent to a selected temperature that is lower than that of the matrix material or materials of the first element 52 and the second element 54.

In additional embodiments, the first element 52 and the second element 54 may comprise portions of a bit body other than those illustrated in FIGS. 2A and 2B, and each may comprise any other portion of a bit body. As another non-limiting example, one or both of the first element 52 and the second element 54 may comprise a portion of a bit body adjacent a cutting element pocket. As described in, for example, U.S. patent application Ser. No. 11/717,905, filed Mar. 13, 2007 (which is entitled "Earth-Boring Tools Having Pockets For Receiving Cutting Elements Therein And Methods Of Forming Such Pockets And Earth-Boring Tools," was filed Mar. 13, 2007, and is assigned to the same assignee of the present invention), it can be difficult to form cutting element pockets having a desired size, shape, and orientation in a bit body of a drill bit due to mechanical interference between tools used to form the cutting element pocket and other portions of the drill bit. Therefore, it may be necessary or desirable to remove (e.g., machine) a relatively larger portion of the drill bit than is required to form the cutting element pocket, and to subsequently re-form a portion of the bit body around the cutting element pocket to replace the excess material removed.

Figure 3A:
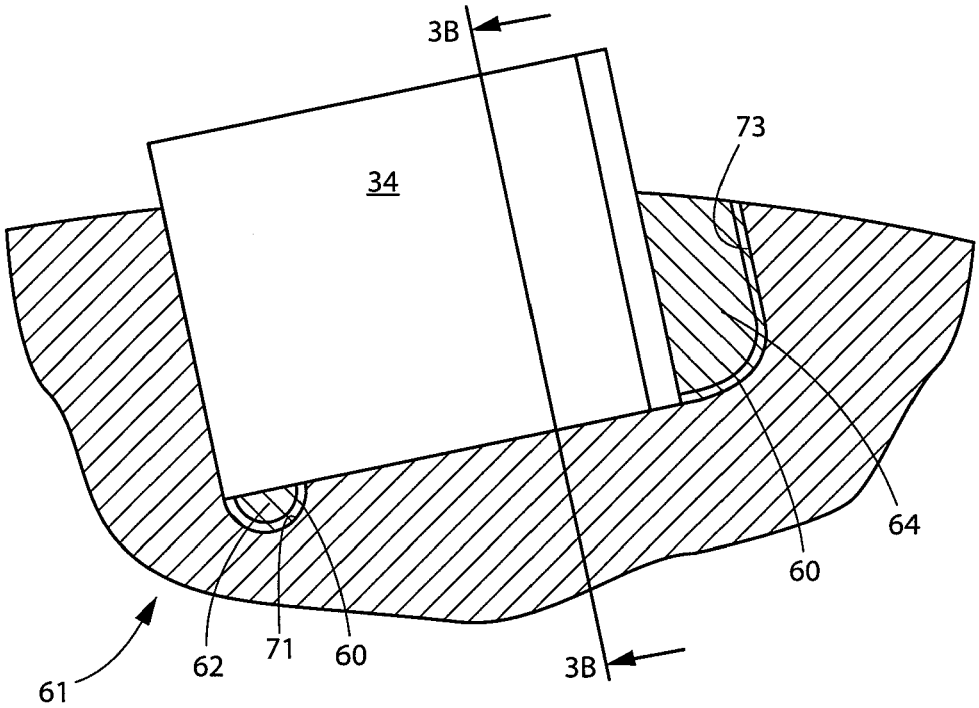
FIG. 3A is a cross-sectional view of a portion of a bit body of an earth-boring rotary drill bit illustrating a cutting element secured within a cutting element pocket that may be formed according to an embodiment of a method of the present invention.
Figure 3B:
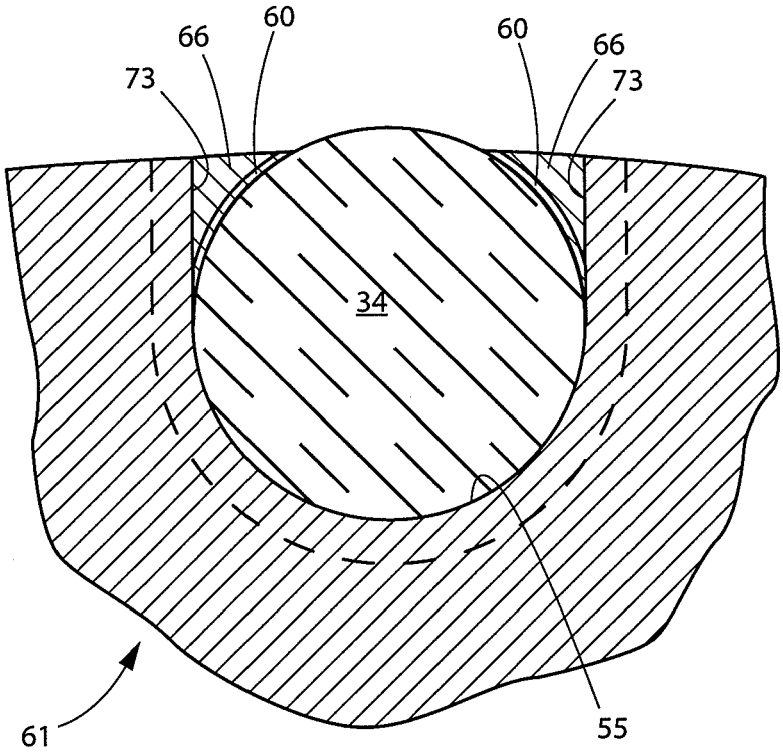
FIG. 3B is a cross-sectional view of the portion of the bit body shown in FIG. 3A taken along section line 3B-3B shown therein.

For example, FIGS. 3A and 3B illustrate a portion of a bit body 61 of an earth-boring rotary drill bit that includes a cutting element 34 secured within a cutting element pocket 36. The cutting element pocket 36 shown in FIG. 1, as well as the manner in which the cutting element pocket 36 may be formed, is described in further detail in the aforementioned pending U.S. patent application Ser. No. 11/717,905. As described therein, the cutting element pocket 36 may be formed by machining one or more recesses into the bit body 61, and subsequently filling at least a portion of the recesses with preformed elements. As a non-limiting example, a first preformed element 62 may be used to fill at least a portion of a first recess 71 in the bit body 61, as shown in FIG. 3A. A second preformed element 64 may be used to fill at least a portion of a second recess 73 at the rotationally forward end of the cutter pocket, as also shown in FIG. 3A. Furthermore, one or more additional preformed elements 66 may be used to fill at least a portion of the second recess 73 in a region over (i.e., radially outward from a longitudinal axis of the drill bit (not shown)) the cutting element 34 to be positioned in the cutting element pocket 36. The first preformed element 62, the second preformed element 64, and the one or more preformed elements 66 may be bonded to the bit body 61 before securing a cutting element 34 within the cutting element pocket 36, after securing a cutting element 34 within the cutting element pocket 36 (so long as the cutting element will not be degraded or harmed by the sintering process), or at substantially the same time the cutting element 34 is secured within the cutting element pocket 36.

In additional embodiments, preformed elements may be used to form other portions of the bit body 61 adjacent the cutting element pocket including, for example, the regions of the bit body 61 rotationally behind, and/or laterally to the side of, the cutting element pocket.

Each of the bit body 61, the first preformed element 62, the second preformed element 64, and the one or more preformed elements 66 may comprise a green, brown, or fully sintered structure, and may be bonded together in a sintering process in a manner substantially similar to that previously described in relation to the first element 52 and the second element 54 with reference to FIGS. 2A and 2B. Displacement members may be used as necessary during such a sintering process to assure that the various components coalesce in such a manner as to provide a desired geometry. For example, displacement members such as those described in U.S. patent application Ser. No. 11/635,432, filed Dec. 7, 2006 and entitled "Displacement Members and Methods of Using Such Displacement Members To Form Bit Bodies Of Earth-Boring Rotary Drill Bits," the disclosure of which is incorporated herein in its entirety by this reference, may be used to assure that the resulting sintered structure has a desired geometry. Furthermore, a metal or metal alloy bonding agent, as previously described herein, may be used to enhance the degree of bonding between the bit body 61 and each of the first preformed element 62, the second preformed element 64, and the one or more additional preformed elements 66. By way of example and not limitation, a foil 60, as previously described herein, may be provided between the bit body 61 and each of the first preformed element 62, the second preformed element 64, and the one or more additional preformed elements 66 prior to sintering the assembly and bonding the first preformed element 62, the second preformed element 64, and the one or more additional preformed elements 66 to the bit body 61.

In yet additional embodiments of the present invention, cutting elements or portions of cutting elements may be bonded to another portion of an earth-boring tool, such as, for example, a bit body of a fixed-cutter earth-boring rotary drill bit or the body of a cone of a roller cone earth-boring rotary drill bit.

Figure 4:
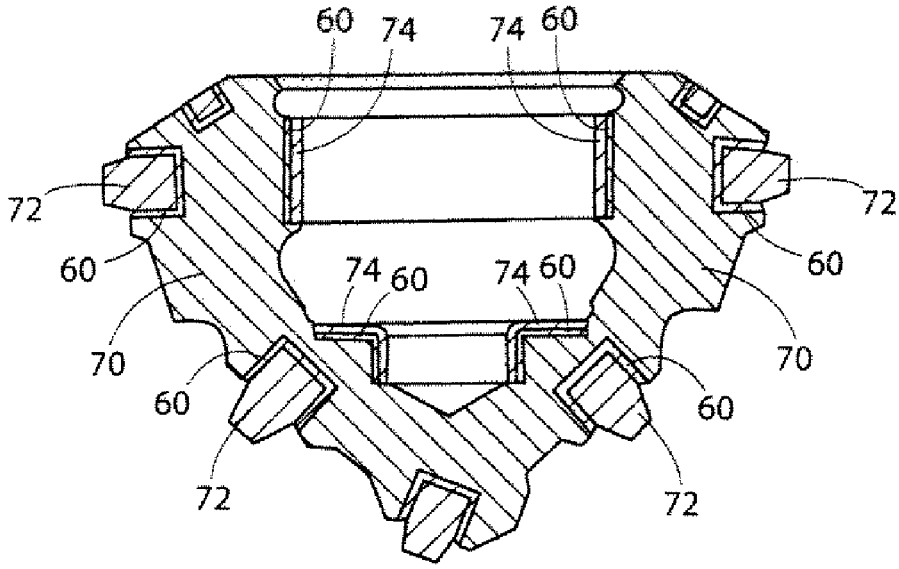
FIG. 4 is a cross-sectional view of a cone that includes cutting element inserts, which may be used on an earth-boring rotary drill bit, and that may be formed according to an embodiment of the present invention.

For example, FIG. 4 illustrates a cross-sectional view of a cone 70 of a roller cone earth-boring rotary drill bit (not shown). The cone 70 shown in FIG. 4, methods for forming the cone 70, and an earth-boring rotary drill bit including such a cone 70, are described in further detail in U.S. patent application Ser. No. 11/710,091 (which is entitled "Earth-Boring Tools And Cutter Assemblies Having A Cutting Element Co-Sintered With A Cone Structure, Methods Of Using The Same," was filed Feb. 23, 2007, and is assigned to the same assignee of the present invention), the entire disclosure of which is incorporated herein in its entirety by this reference.

As described in the aforementioned U.S. patent application Ser. No. 11/710,091, cone 70 may be predominantly comprised of a particle-matrix composite material, and cutting inserts 72 that also comprise a particle-matrix composite material may be co-sintered with the cone 70 to form a bond between the cone 70 and the cutting inserts 72. Furthermore, bearing structures 74 may be co-sintered with the cone 70 to form a bond between the cone 70 and the bearing structures 74.

Each of the cone 70, the cutting inserts 72, and the bearing structures 74 may comprise a green, brown, or fully sintered structure, and may be bonded together in a sintering process in a manner substantially similar to that previously described in relation to the first element 52 and the second element 54 with reference to FIGS. 2A and 2B. Furthermore, a metal or metal alloy bonding agent, as previously described herein, may be used to enhance the degree of bonding between the cone 70 and each of the cutting inserts 72 and the bearing structures 74. By way of example and not limitation, a foil 60, as previously described herein, may be provided between the cone 70 and each of the cutting inserts 72 and the bearing structures 74 prior to sintering the assembly and bonding the cutting inserts 72 and the bearing structures 74 to the cone 70.

Figure 5:
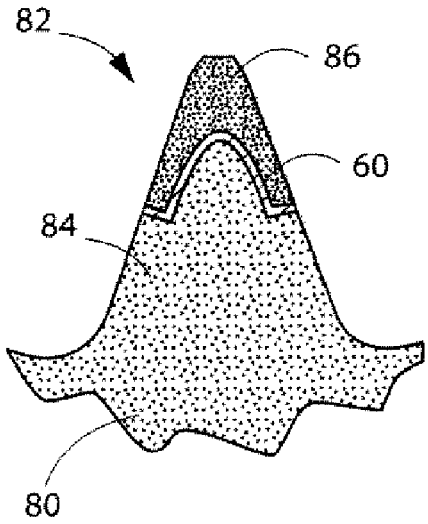
FIG. 5 is a cross-sectional view of a cutting tooth structure that may be used on an earth-boring rotary drill bit and that may be formed according to an embodiment of the present invention.

FIG. 5 illustrates a portion of another cone 80 that includes a cutting tooth structure 82. For example, the cone 80 may be similar to a so-called "milled-tooth" cone. The cutting tooth structure 82 includes a tooth base structure 84 and a tooth cap structure 86 that is bonded to the tooth base structure 84. The cone 80 shown in FIG. 5, methods for forming the cone 80, and an earth-boring rotary drill bit including such a cone 80, are described in further detail in the aforementioned pending U.S. patent application Ser. No. 11/710,091. As described in the aforementioned pending U.S. patent application Ser. No. 11/710,091, the tooth base structure 84 and the tooth cap structure 86 of the cutting teeth 82 of the cone 80 may comprise a particle-matrix composite material, and may be co-sintered to form a bond between the tooth base structure 84 and the tooth cap structure 86. Each of the tooth base structure 84 and the tooth cap structure 86 may comprise a green, brown, or fully sintered structure, and may be bonded together in a sintering process in a manner substantially similar to that previously described in relation to the first element 52 and the second element 54 with reference to FIGS. 2A and 2B. The tooth base structure 84 may be machined or otherwise formed on and/or in the surface of the cone 80 when the cone 80 is in the green, brown, or fully sintered state. The tooth cap structure 86 may be formed separately and attached to the tooth base structure 84 during the sintering process.

Furthermore, a metal or metal alloy bonding agent, as previously described herein, may be used to enhance the degree of bonding between the tooth base structure 84 and the tooth cap structure 86. By way of example and not limitation, a foil 60, as previously described herein, may be provided between the tooth base structure 84 and the tooth cap structure 86 prior to sintering the assembly and bonding the tooth cap structure 86 to the tooth base structure 84.

Figure 6:
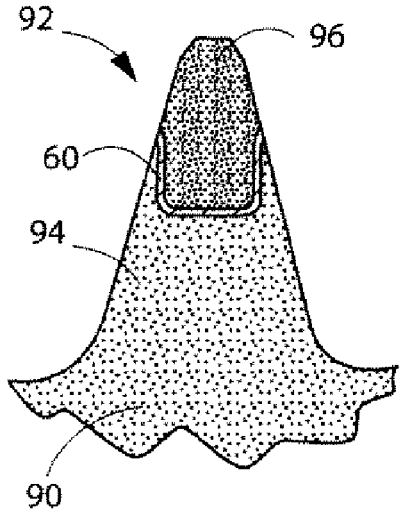
FIG. 6 is a cross-sectional view of another cutting tooth structure that may be used on an earth-boring rotary drill bit and that may be formed according to an embodiment of the present invention.

FIG. 6 illustrates a portion of another cone 90 that includes another cutting tooth structure 92 that is generally similar to the cutting tooth structure 82. The cutting tooth structure 92 includes a tooth base structure 94 and a tooth plug structure 96 that is bonded within a recess in the tooth base structure 94. The cone 90 shown in FIG. 6, methods for forming the cone 90, and an earth-boring rotary drill bit including such a cone 90, are described in further detail in the aforementioned pending U.S. patent application Ser. No. 11/710,091. As described therein, the tooth base structure 94 and the tooth plug structure 96 of the cutting teeth 92 of the cone 90 may comprise a particle-matrix composite material, and may be co-sintered to form a bond between the tooth base structure 94 and the tooth plug structure 96. Each of the tooth base structure 94 and the tooth plug structure 96 may comprise a green, brown, or fully sintered structure, and may be bonded together in a sintering process in a manner substantially similar to that previously described in relation to the first element 52 and the second element 54 with reference to FIGS. 2A and 2B. Furthermore, a metal or metal alloy bonding agent, as previously described herein, may be used to enhance the degree of bonding between the tooth base structure 94 and the tooth plug structure 96. By way of example and not limitation, a foil 60, as previously described herein, may be provided between the tooth base structure 94 and the tooth plug structure 96 prior to sintering the assembly and bonding the tooth plug structure 96 to the tooth base structure 94.

Providing a bonding agent between elements prior to sintering the elements to form a bond therebetween, as previously described herein, may enable improved bonding between the elements during the sintering process. For example, using a bonding agent as described herein may reduce or prevent the formation of voids or recesses at the interface between the elements that would otherwise form during a sintering process. Accordingly, earth-boring tools and methods for forming at least portions of such earth-boring tools may be improved according to embodiments of the present invention.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility with different and various bit profiles as well as cutting element types and configurations.

What is claimed is:

1. A method of forming an earth-boring rotary drill bit comprising:

providing a bonding agent comprising a metal material at an interface between a first element and a second element;

selecting the first element to comprise at least a portion of a bit body of the earth-boring rotary drill bit including a pocket sized and configured to receive at least a portion of a cutting element;

selecting the first element to comprise a first green or brown structure comprising hard particles and a metal or metal alloy matrix material;

selecting the second element to comprise at least a portion of a cutting element;

selecting the second element to comprise a second green or brown structure comprising hard particles and a metal or metal alloy matrix material; and sintering the first element, the second element, and the bonding agent to form a bond between a particle-matrix composite material of the first element and a particle-matrix composite material of the second element along the interface.

2. The method of claim 1, further comprising forming the first element to have a first material composition and forming the second element to have a second material composition differing from the first material composition.

3. The method of claim 1, further comprising selecting the bonding agent to exhibit a melting point equal to or less than each of a melting point exhibited by the metal or metal alloy matrix material of the first element and a melting point exhibited by the metal or metal alloy matrix material of the second element.

4. The method of claim 3, wherein selecting the bonding agent further comprises selecting the bonding agent to be substantially comprised of at least one of nickel, a nickel-based alloy, cobalt, a cobalt-based alloy, silver, and a silver-based alloy.

5. The method of claim 1, wherein providing the bonding agent comprising the metal material at the interface comprises at least partially covering a surface of at least one of the first element and the second element with a foil comprising the bonding agent.

6. The method of claim 5, further comprising forming at least a portion of the foil to conform to at least a portion of the surface of the at least one of the first element and the second element prior to covering the surface of the at least one of the first element and the second element with the foil.

7. The method of claim 1, wherein providing the bonding agent comprising the metal material at the interface comprises applying a powder comprising particles of the bonding agent to at least a portion of a surface of at least one of the first element and the second element.

8. A method of forming an earth-boring rotary drill bit comprising:

providing a bonding agent comprising a metal material at an interface between a first element and a second element;

selecting the first element to comprise at least a portion of a bit body of the earth-boring rotary drill bit including at least one recess sized and configured to receive at least a portion of at least one cutting element therein;

selecting the first element to comprise a first green or brown structure comprising hard particles and a metal or metal alloy matrix material;

selecting the second element to comprise an additional portion of the bit body of the earth-boring rotary drill bit;

selecting the second element to comprise a second green or brown structure comprising hard particles and a metal or metal alloy matrix material; and sintering the first element, the second element, and the bonding agent to form a bond between a particle-matrix composite material of the first element and a particle-matrix composite material of the second element along the interface.

9. A method of forming a cutter assembly for use on an earth-boring tool, the method comprising:

forming at least a portion of a roller cone for an earth-boring tool, the at least a portion of a roller cone including at least one surface sized and configured to be complementary to at least a portion of a cutting element and comprising a green or brown structure including a plurality of hard particles and a metal or metal alloy matrix material;

positioning at least one cutting element on the at least a portion of a roller cone;

providing a metal or metal alloy bonding agent at an interface between the at least a portion of a roller cone and the at least one cutting element; and sintering the at least a portion of a roller cone and the at least one cutting element to form a bond between the at least a portion of a roller cone and the at least one cutting element.

10. The method of claim 9, further comprising forming the at least one cutting element to comprise a green or brown structure prior to sintering the at least a portion of a roller cone and the at least one cutting element.

11. The method of claim 10, further comprising machining at least one aperture in the at least a portion of a roller cone and inserting the at least one cutting element into the at least one aperture of the at least a portion of a roller cone prior to sintering the at least a portion of a roller cone and the at least one cutting element.

12. The method of claim 10, further comprising machining at least one protrusion on the at least a portion of a roller cone and placing the at least one cutting element on the at least one protrusion of the at least a portion of a roller cone prior to sintering the at least a portion of a roller cone and the at least one cutting element.

13. The method of claim 9, further comprising:

positioning at least one bearing structure on the at least a portion of a roller cone;

providing another metal or metal alloy bonding agent at an interface between the at least a portion of a roller cone and the at least one bearing structure; and sintering the at least a portion of a roller cone and the at least one bearing structure and forming a bond between the at least a portion of a roller cone and the at least one bearing structure.

14. The method of claim 9, further comprising selecting the bonding agent to exhibit a melting point equal to or less than each of a melting point exhibited by the metal or metal alloy matrix material of the at least a portion of a roller cone and a melting point exhibited by a matrix material of the at least one cutting element.

15. The method of claim 9, further comprising selecting the bonding agent to be substantially comprised of at least one of nickel, a nickel-based alloy, cobalt, a cobalt-based alloy, silver, and a silver-based alloy.

16. The method of claim 9, wherein providing the metal or metal alloy bonding agent at the interface comprises at least partially covering a surface of at least one of the at least a portion of a roller cone and the at least one cutting element with a foil comprising the bonding agent.

17. The method of claim 16, further comprising forming at least a portion of the foil to conform to at least a portion of the surface of the at least one of the at least a portion of a roller cone and the at least one cutting element with a foil comprising the bonding agent prior to covering the surface of the at least one of the at least a portion of a roller cone and the at least one cutting element with the foil.

18. The method of claim 9, wherein providing the metal or metal alloy bonding agent at the interface comprises applying a powder comprising particles of the bonding agent to at least a portion of a surface of at least one of the at least a portion of a roller cone and the at least one cutting element.

19. An intermediate structure in a process for forming an earth-boring rotary drill bit comprising:

a first element comprising at least a portion of a bit body of the earth-boring rotary drill bit including a pocket sized and configured to receive at least a portion of a cutting element, the first element comprising a first green or brown structure including hard particles and a metal or metal alloy matrix material;

a second element comprising at least a portion of a cutting element, the second element comprising a second green or brown structure including hard particles and a metal or metal alloy matrix material; and a metal or metal alloy bonding agent at an interface between the first element and the second element.

20. The intermediate structure in a process for forming an earth-boring rotary drill bit of claim 19, wherein the first element has a first material composition and the second element has a second material composition differing from the first material composition.

21. The intermediate structure in a process for forming an earth-boring rotary drill bit of claim 19, wherein the bonding agent exhibits a melting point equal to or less than each of a melting point exhibited by the metal or metal alloy matrix material of the first element and a melting point exhibited by the metal or metal alloy matrix material of the second element.

22. The intermediate structure in a process for forming an earth-boring rotary drill bit of claim 19, wherein the bonding agent is substantially comprised of at least one of nickel, a nickel-based alloy, cobalt, a cobalt-based alloy, silver, and a silver-based alloy.

23. The intermediate structure in a process for forming an earth-boring rotary drill bit of claim 19, further comprising a foil at the interface between the first element and the second element, the foil comprising the bonding agent.

24. The intermediate structure in a process for forming an earth-boring rotary drill bit of claim 23, wherein the foil is preformed to conform to at least a portion of a surface of at least one of the first element and the second element.

25. The intermediate structure in a process for forming an earth-boring rotary drill bit of claim 19, further comprising a powder at the interface between the first element and the second element, the powder including particles comprising the bonding agent.

26. An intermediate structure in a process for forming an earth-boring rotary drill bit comprising:

a first element comprising at least a portion of a bit body of the earth-boring rotary drill bit including at least one recess sized and configured to receive at least a portion of at least one cutting element therein, the first element comprising a first green or brown structure including hard particles and a metal or metal alloy matrix material;

a second element comprising an additional portion of the bit body of the earth-boring rotary drill bit, the second element comprising a second green or brown structure including hard particles and a metal or metal alloy matrix material; and a metal or metal alloy bonding agent at an interface between the first element and the second element.

27. An intermediate structure in a process for forming an earth-boring rotary drill bit comprising:

a first element comprising at least a portion of a cone of a roller cone earth-boring rotary drill bit including at least one surface sized and configured to be complementary to at least a portion of a cutting element, the first element comprising a green or brown structure including a plurality of hard particles and a metal or metal alloy matrix material;

a second element comprising at least a portion of a cutting element; and a metal or metal alloy bonding agent at an interface between the first element and the second element.

* * * * *